US005996556A

United States Patent [19]

Klinger et al.

[11] Patent Number: 5,996,556

[45] Date of Patent: Dec. 7, 1999

[54] QUANTITY CONTROL VALVE

[75] Inventors: Horst Klinger, Ludwigsburg; Uwe Kuhn, Riederich; Marcel Wuest, Korntal; Bernd Roseneau, Tamm; Peter Traub, Stuttgart; Thomas Goettel, Schwaikheim; Gerd Loesch, Stuttgart; Sandro Soccol, Bietigheim-Bissingen, all of Germany

[73] Assignee: Robert Bosch GmbH, Stuttgart, Germany

[21] Appl. No.: 09/098,354

[22] Filed: Jun. 17, 1998

[30] Foreign Application Priority Data

Jun. 17, 1997 [DE] Germany ..... 197 25 472

[51] Int. Cl.[6] ..... F02M 47/00

[52] U.S. Cl. ..... 123/446; 123/463

[58] Field of Search ..... 123/446, 463, 123/510; 137/115.07

[56] References Cited

U.S. PATENT DOCUMENTS 4,355,655 10/1982 Hertell et al. ..... 137/115.07

4,895,184 1/1990 Abbey ..... 123/463

5,884,606 3/1999 Kellner et al. ..... 123/446

*Primary Examiner*—Thomas N. Moulis

*Attorney, Agent, or Firm*—Edwin E. Greigg; Ronald E. Greigg

[57] ABSTRACT

The invention relates to a quantity control valve for a fuel injection system, used in internal combustion engines, with a longitudinal slide that is movable in a valve housing between a restoring spring chamber and a control chamber and that allocates the fuel, flowing in from at least one low-pressure pump, to at least one high-pressure pump. For driving the longitudinal slide, the inflowing fuel in the control chamber is delivered past the longitudinal slide via a throttle or baffle valve. In the closing position, firstly, a cylindrical guide region of the longitudinal slide bounded on both sides by annular grooves blocks off an inlet bore. The guide region is wider than the diameter of the inlet bore. Secondly, it covers an outlet bore except for a partial intersection with the relieved annular groove shifted into the return in the opening direction of the longitudinal slide. By the disposition of the inlet and outlet bores in combination with the contour of the longitudinal slide, a zero quantity feed can be unambiguously represented in the blocking position of the longitudinal slide.

14 Claims, 2 Drawing Sheets

QUANTITY CONTROL VALVE

BACKGROUND OF THE INVENTION

The invention is based on a quantity control valve for a fuel injection system used in internal combustion engine.

From German Patent Application DE 195 49 108.4, which had not been published by the filing date of the present priority application, among other things a quantity control valve is disclosed, which has a longitudinal slide that is movable in a valve housing between:a restoring spring chamber and a control chamber and that opens counter to the action of a restoring spring. The hollow longitudinal slide is acted upon by fuel from a low-pressure pump via the restoring spring chamber. By means of a throttle restriction located in the longitudinal slide, the fuel reaches the control chamber. As soon as the fuel pressure there exceeds a certain value, the longitudinal slide opens counter to the action of the relief chamber, and as a result, the fuel reaches the high-pressure pump through the longitudinal slide, via an outlet bore that has been opened. The opening of the valve is additionally reinforced with the aid of an electromagnetic drive acting directly on the longitudinal slide.

A quantity control valve is also known from European Patent Disclosure EP 0 299 337; it has a pressure slide for controlling the flow cross section to the high-pressure pump. Such a valve cannot be controlled precisely enough and requires a complicated lever arrangement for its actuation.

OBJECT AND SUMMARY OF THE INVENTION

The quantity control valve of the invention allocates the fuel, flowing in from at least one low-pressure pump, to at least one high-pressure pump. For driving the longitudinal slide, the inflowing fuel in the control chamber is delivered past the longitudinal slide via a throttle or baffle valve. In the closing position, on the one hand a cylindrical guide region of the longitudinal slide bounded on both sides by annular grooves blocks off an inlet bore. The guide region is wider than the diameter of the inlet bore. Second, it covers an outlet bore except for a partial intersection with the relieved annular groove shifted into the return in the opening direction of the longitudinal slide.

This quantity control valve requires no external electromechanical drive. The drive of the longitudinal slide is effected solely via the fuel pumped by the low-pressure pump upstream. In the valve, when the longitudinal slide is in the open position, the fuel is carried over the shortest route through the slide region, so that when the flow is through the valve there is only minimal throttling. When the quantity control valve is closed, the intake line of the high-pressure pump connected to the outlet bore of the valve communicates with the return, because of the contour of the longitudinal slide. The quantity of leaking fuel present at the longitudinal slide via the pressure line of the low-pressure fuel pump flows through the gap between the longitudinal slide and the bore guiding fuel into the guide region that at the same time blocks off the inlet bore, and then flows out via the outlet bore into the return. As a result, no pressure can build up in the line to the high-pressure pump. The high-pressure pumping is thus discontinued entirely.

In the structural embodiment of the quantity control valve, the longitudinal slide may be supported with or without a guide sleeve relative to the valve housing. The location of the two intersection curves between the bore that supports the longitudinal slide and the inlet and outlet bores does not depend on this.

With one quantity control valve, a plurality of high-pressure pumps can be supplied independently of one another.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
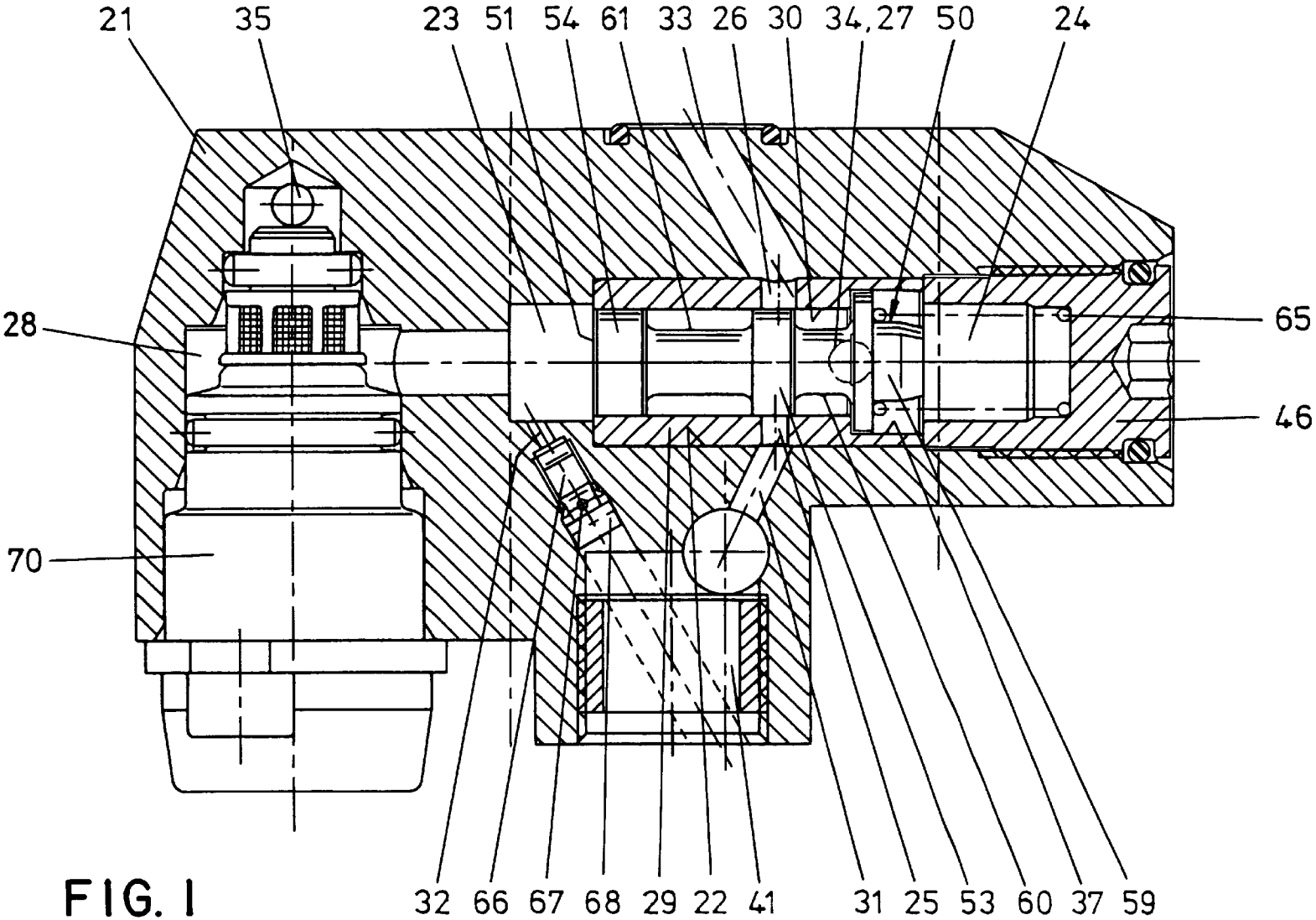
FIG. 1 schematically shows a partial cross-sectional view of a quantity control valve with inlets and outlets virtually facing one another.

FIG. 1 shows a valve housing 21 with a central bore 22, in which a guide sleeve 29 is disposed. Supported in the guide sleeve 29 is a longitudinal slide 50 in a guide bore 30, into which an inlet bore 31, an outlet bore 33, a control bore 32, and a return bore 34, this last bore being concealed here by the control slide in the form of a longitudinal slide 50. The guide sleeve 29 has corresponding transverse bores 25, 26 and 27 opposite the mouths of the bores 31, 33 and 34, respectively, into the central bore 22. A common inlet connection 41 is disposed upstream of the inlet bore 31 and control bore 32. The compression side of the low-pressure pump that pumps the fuel through the quantity control valve is connected to the inlet connection 31. The outlet bore 33 leads to the intake side of at least one downstream high-pressure pump. The return bore 34 ends in the tank.

A throttle 66 is seated in the control bore 32. By way of example, the throttle is embodied as a screw with a cylindrical head 68. In its threaded portion, the screw has a central throttle bore, not shown here, which discharges into a transverse bore 67. The fuel reaches the transverse bore 67 through the annular gap located between the wall of the control bore 32 and the outer contour of the screw head 68. The annular gap, which has a filtering action, has a gap width crosswise to the control bore 32 that is less than the diameter of the throttle bore.

The control bore 32 discharges into the control chamber 23, which is also bordered by a seat bore 28. A magnet valve 70 is screwed into the seat bore 28. The magnet valve 70 is an electromagnetically actuated 2/2-way valve, which discharges into the return via a bore 35. The 2/2-way valve 70 has one blocking and one open position, by way of example; in the currentless state, it is kept in the blocking position via a restoring spring. Optionally, the flow through the valve may also be controlled in proportion to the valve stroke.

On the other end of the valve housing 21, the central bore 22 is closed with a screwed-in, sealed-off housing cap 46. The housing cap 46 on the one hand fixes the guide sleeve 29 in the central bore 22 and on the other supports a restoring spring 65 of the longitudinal slide 50. The restoring spring 65 is surrounded by a control chamber 24.

In the exemplary embodiment, the longitudinal slide 50 has a substantially cylindrical shaft, which ends in the control chamber 24 in the form of a head 59 which has a diameter that is larger than the bore 30, and the restoring spring 65 rests on this head. The head 59 is located inside the guide sleeve 29, in a stop bore 37 whose inside diameter is greater than the inside diameter of the slide bore 30 and the restoring spring chamber 24, so that the stroke of the longitudinal slide is defined by the length of the stop bore 37.

Among other regions, the shaft of the longitudinal slide 50 has two cylindrical guide and piston regions 53 and 54, respectively, which rest, sliding tightly, in the slide bore 30. The annular grooves 60 and 61 adjoin the guide region 53 that forms control edges on both sides.

In the blocking position of the quantity control valve, one of the control edges of the guide region 53 has moved all the way past the outlet 26 and the inlet 25, so that the entire guide region 53 is located upstream of both the inlet 25 and the outlet 26. In this situation, the inlet 25 is completely blocked, while the outlet 26 is partly re-opened toward the annular groove 60 by another one of the control edges of the guide region 53. Consequently, in the blocking position of the longitudinal slide 50, the outlet bore 33 communicates hydraulically with the return bore 34. The fuel pressure is relieved to the tank.

In principle, however, the inlet 25 may also be located such that it communicates constantly with the annular groove 61. In that case, it is possible to provide the guide or piston region 54 with a longitudinal notch, flattened face or the like, instead of the throttle 66, and these features then take on the task of a throttle restriction; see FIG. 2.

The transverse bores 25 and 26, which are of different sizes, are for instance disposed such that their bore walls in an ideal case touch a transverse plane located normally to the imaginary center line of the central bore 22, or in other words do not intersect that plane. This transverse plane intersects the longitudinal slide 50 in the region 53 in a zone between the center of this guide region and the control edge oriented toward the annular groove 61. With this disposition of the transverse bore, the fuel flowing into the chamber of the annular groove 61 is pumped, in the opening motion of the longitudinal slide 50, into the outlet bore to the high-pressure pump without substantial flow deflection. Since the outlet transverse bore 26 has a greater diameter than the inlet transverse bore 25, the opening cross section that is uncovered for the outlet transverse bore 26 is always greater than for the inlet transverse bore 25. Thus only insignificant throttling occurs here.

The diameter of the outlet transverse bore 26 is selected to be great enough than the outlet transverse bore 26, in the blocking position of the longitudinal slide 50, regionally protrudes by approximately 0.5 mm past the control edge located between the guide region 53 and the annular groove 60. Consequently, the outlet bore 33, up to an opening stroke of the longitudinal slide 50 of 0.5 mm, communicates with the annular groove 60 and thus with the return bore 34.

In this exemplary embodiment, the precise location of transverse bores 25, 26 which are machined into the guide sleeve 29 has been described. In the case where some other structural embodiment—with or without a guide sleeve instead of the transverse bores at least one bore obliquely intersects the slide bore 30 or meets it in a skewed way, only the penetrating curves that result upon intersection between the slide bore 30 and the applicable bores (either the two bores 25, 26 or the two bores 31, 33) or conduits, are tangent to the common transverse plane.

In the view shown in FIG. 1, the longitudinal slide 50 is in the blocking position. No fuel is fed to the high-pressure pump. If the longitudinal slide 50 is opened completely, counter to the action of the restoring spring, then the maximum volume flows through the inlet and outlet bores 31, 32. This volumetric flow is a function of the inflow pressure of the fuel pumped by the low-pressure pump 1, the bore cross sections of the bores 31, 32, or the bores 25, 26, and the flow cross section in the annular groove 61 of the longitudinal slide 50.

When the magnet valve 70 is closed, the quantity control valve opens as soon as a pressure has built up in the control chamber 23, as a result of the fuel flowing via the throttle 66, which pressure when multiplied by the effective area of the end face 51 results in a pressure that is greater than the spring force of the restoring spring 65. The spring rate here may have a linear, progressive or degressive characteristic curve. The fuel pressure in the control chamber 23 is regulated by the magnet valve 70.

Figure 2:
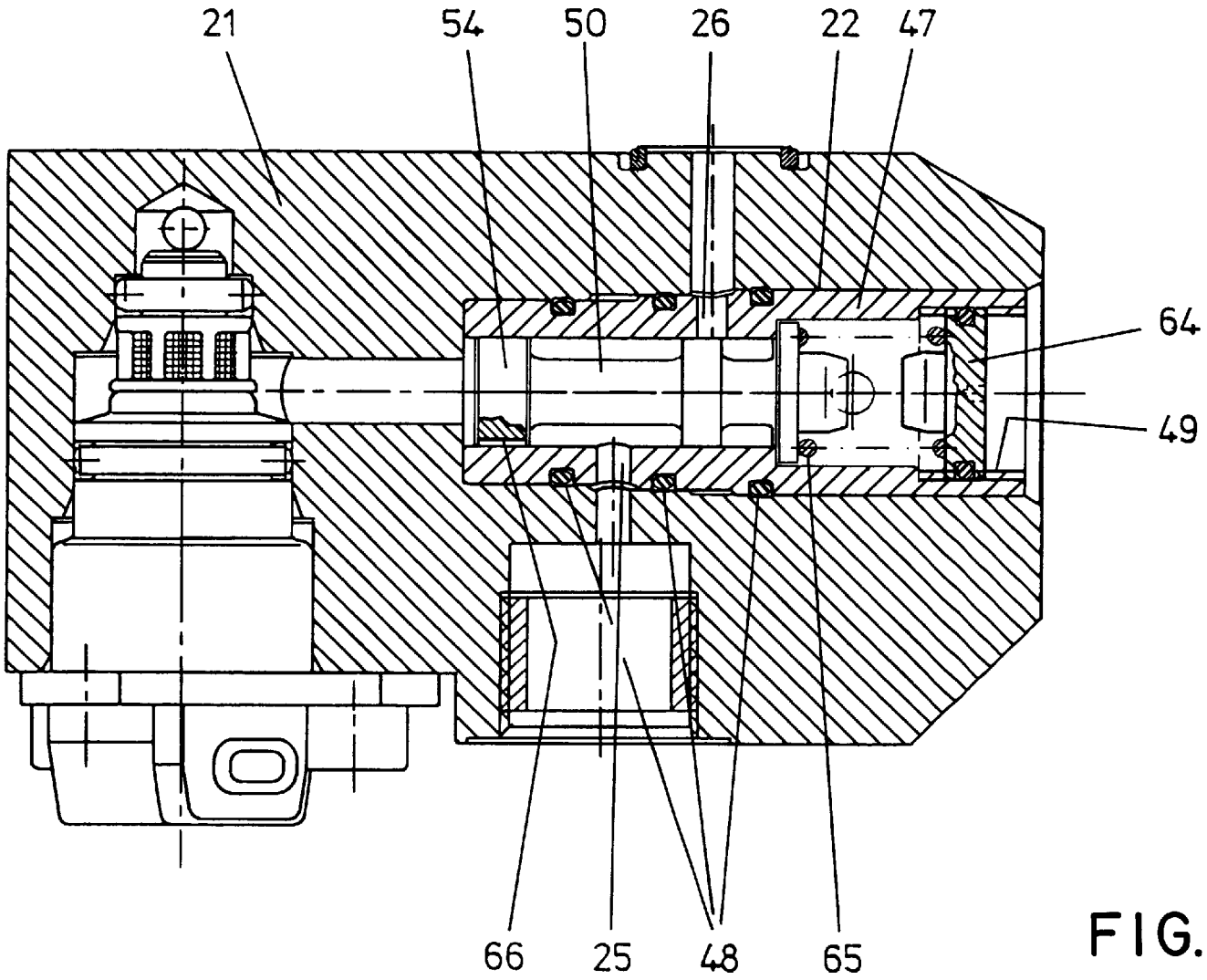
FIG. 2 schematically shows a partial cross-sectional view of a quantity control valve with staggered inlets and outlets in a cartridge design.

FIG. 2 shows a variant with a cartridge design. Here the guide sleeve 29 and the housing cap 46 of FIG. 1 are combined into a cartridge 47. The cartridge 47 contains the longitudinal slide 50, restoring spring 65, and a screwed-in spring plate 64 that is provided with a seal, all of these elements being mounted in their final position and adjusted. It thus forms a complete metering unit. The cartridge 47 has a transverse press-fit seat in the central bore 22, for instance. Sealing rings 48 mounted on the cartridge 47 are disposed on both sides of the staggered inlets and outlets 25, 26. Via the thread 49 that holds the spring plate 64, the cartridge 47 can be pulled out of the valve housing 21 for replacement or maintenance purposes.

The cartridge 47 can be inexpensively preassembled and adjusted outside the valve housing. Because of its modular design, it can also be used as a metering unit in other valves as well.

The foregoing relates to a preferred exemplary embodiment of the invention, it being understood that other variants and embodiments thereof are possible within the spirit and scope of the invention, the latter being defined by the appended claims.

We claim:

1. A quantity control valve for delivering fuel from a low-pressure source to a high-pressure pump that is used to supply a high-pressure fuel chamber of a fuel injection system for internal combustion engines, having a valve member (50) which is adjustable as a function of a control pressure counter to the force of a spring (65), a control slide (50) which acts as the valve member is displaceably disposed in a slide bore (30) and which with one face end (51) defines a control chamber (23) in which the control pressure prevails and which has first and second piston regions (53, 54) that between them enclose an annular groove (61), said annular groove (61) can be made to communicate with the low-pressure source via the inlet (25) and with the high-pressure chamber via an outlet (26), and the communication with the outlet (26) is opened increasingly by means of a control edge, formed on said first piston region (53) of the piston regions, as the control slide (50) is displaced counter to the spring (65).

2. A quantity control valve in accordance with claim 1, in which to control the control pressure, the control chamber (23) communicates constantly via a throttle (66) with the low pressure source and can be made to communicate with a first relief chamber via a relief opening (35) controlled by an electrically controlled valve (70) as a function of operating parameters.

3. A quantity control valve in accordance with claim 2, in which the control slide (50) is displaceable by the spring (65) up to a stop (37), and in this position the communication between the annular groove (61) and the outlet (26) is interrupted.

4. A quantity control valve in accordance with claim 3, in which when the control slide (50) is located on the stop (37), the inlet (25) is closed by the first piston region (53), and via another control edge on the one of the piston regions (53), the outlet (26) is made to communicate with a relief bore (34, 27).

5. A quantity control valve in accordance with claim 4, in which the spring (65) disposed in a spring chamber (24) which communicates with the relief bore, and the outlet (26) can be made to communicate with the relief bore via the slide bore (30).

6. A quantity control valve in accordance with claim 4, in which the inlet (25) communicates constantly with the annular groove (61).

7. A quantity control valve in accordance with claim 5, in which the inlet (25) communicates constantly with the annular groove (61).

8. A quantity control valve in accordance with claim 2, in which the pressure source with which the control chamber (23) communicates is the low-pressure source.

9. A quantity control valve in accordance with claim 3, in which the pressure source with which the control chamber (23) communicates is the low-pressure source.

10. A quantity control valve in accordance with claim 4, in which the pressure source with which the control chamber (23) communicates is the low-pressure source.

11. A quantity control valve in accordance with claim 5, in which the pressure source with which the control chamber (23) communicates is the low-pressure source.

12. A quantity control valve in accordance with claim 6, in which the pressure source with which the control chamber (23) communicates is the low-pressure source.

13. A quantity control valve in accordance with claim 4, in which in a blocking position of the longitudinal slide (50), the outlet bore (26, 33), measured in the longitudinal direction of the longitudinal slide, overlaps the annular groove (60) regionally by nearly 0.5 mm.

14. A quantity control valve in accordance with claim 1, in which the longitudinal slide (50) is supported in a guide sleeve (29) in which at least upstream of the inlet bore (31), upstream of the outlet bore (33) and upstream of a return bore (34), one transverse bore each (25, 26 and 27), is respectively disposed.

* * * * *